US005641284A

United States Patent [19]

Minovitch

[11] Patent Number: 5,641,284

[45] Date of Patent: Jun. 24, 1997

[54] FLASH BULB CARTRIDGE FOR LIGHT GUNS

[76] Inventor: Michael Andrew Minovitch, 2832 St. George St. #6, Los Angeles, Calif. 90027

[21] Appl. No.: 458,432

[22] Filed: Jun. 2, 1995

[51] Int. Cl.[6] ..... F21K 5/00

[52] U.S. Cl. ..... 431/359; 362/15

[58] Field of Search ..... 431/358, 359, 431/360, 362; 362/13, 14, 15

[56] References Cited

U.S. PATENT DOCUMENTS

| | | | |
|---|---|---|---|
| 2,191,402 | 2/1940 | Saffir et al. | 431/359 |
| 2,858,686 | 11/1958 | Roth | 431/360 |
| 3,319,058 | 5/1967 | Toomey et al. | 431/359 |

*Primary Examiner*—Carroll B. Dority
*Attorney, Agent, or Firm*—Christie, Parker & Hale, LLP

[57] ABSTRACT

An ultra high intensity flash cartridge is provided for light guns. The ultra high intensity of the flash is obtained by sealing fast burning filaments of magnesium inside a glass bulb containing pure oxygen gas under pressure. The flash is triggered by an electric current. The intensity is boosted by designing the rear surface of the bulb with a paraboloidal shape and coating it with a reflective surface so that all the light is projected and concentrated in the forward direction without requiring any external reflector. Guide flanges are built into the bulb to maintain proper orientation when loaded into a light gun. The cartridge is capable of generating a light flash several orders of magnitude brighter than the noon-day sun for temporarily blinding an assailant at a distance.

8 Claims, 2 Drawing Sheets

FLASH BULB CARTRIDGE FOR LIGHT GUNS

BACKGROUND

The amount of violent crime committed in the United States against defenseless victims is very high and increasing at a rapid rate. Consequently, there is a strong demand for effective self defense devices.

Most devices used for self defense are: (1) fire arms (pistols and rifles); (2) electric shock devices (stun guns); (3) chemical sprays (MACE); or (4) sound generators (whistles or horns). Unfortunately, carrying a concealed weapon such as a pistol requires a gun permit which, in many states, is difficult to obtain. Pistols are also lethal weapons that can result in the victim's death if the victim is overpowered by the assailant. The use of a stun gun to disable an assailant by electric shock requires physical contact with the assailant. But this close proximity operation of stun guns makes the victim vulnerable to being overpowered by the assailant. Projecting a chemical spray into the eyes of an assailant is not easy or effective unless the victim is relatively close to the assailant, and hence, vulnerable to being overpowered. Making a noise or sounding an alarm is useless against a determined assailant.

My previous light gun inventions (U.S. Pat. No. 5,072,342 issued Dec. 10, 1991 and U.S. Pat. No. 5,243,894 issued Sep. 14, 1993 entitled "Light Gun") represented a fundamentally new innovation in the art of self defense devices in that they provided a means for immobilizing an assailant at a safe distance by temporarily blinding the assailant. They were designed to generate a light flash by discharging an energy storage capacitor through an electronic flash robe. Although the flash robes can be used repetitively without burning out, they required high energy storage capacitors which are expensive. The present invention represents an important technical improvement in that the light flashes are generated by a different process that is designed to obtain much greater flash intensities for more effective results. The flashes are generated by igniting a fast-burning substance such as magnesium filaments inside a sealed glass bulb triggered by an electric current. Thus, the flash bulbs are burned out after each flash and can not be used respectively. The present invention utilizes this flash generating principle to provide a low cost ultra high intensity disposable flash bulb "cartridge" for shooting bursts of light (light bullets) in new light guns designed to fire these cartridges.

BRIEF SUMMARY OF THE INVENTION

Thus, in the practice of this invention, the presently preferred embodiment typically comprises a hermetically sealed, current activated, flash bulb made of quartz glass. The flash bulb is nearly spherical with an outside transverse diameter of about 1½ inches and contains many filaments of magnesium designed to burn almost instantaneously in a brilliant light flash. The flash intensity of the bulb is boosted by filling the interior with pure oxygen gas under pressure. The bulb is fired by an electric current fed into the bulb by a standard 9 volt battery. The peak intensity is approximately 20 million ($2\times10^7$) lumens (which is approximately 1,000 times brighter than the sun at noon) and exceeds 10 million ($10^7$) lumens for a period of about 20 milliseconds (20 msec). The time to reach peak intensity is about 30 msec. Thus, it is impossible to avoid receiving a blinding light flash by closing the eyes if the eyes are open when a flash bulb is fired. The intensity of the light flash is boosted by designing the rear surface of the bulb with a paraboloidal shape and coating it with a reflective surface so that the light flash is projected and concentrated in the forward direction without requiring any external reflector. Guide flanges are built into the bulb to maintain proper orientation when loaded into a light gun designed to use these flash bulb cartridges. By pressurizing the bulbs with pure oxygen gas, they can carry more magnesium filaments to generate a much more intense light flash while having a relatively small size. This is an important design feature of the invention. These super high power flash bulbs can be regarded as cartridges for light guns. Electric current is fed into the cartridges via small electrodes extending on each side through the guide flanges.

DRAWINGS

These and other advantages and features of the invention will be apparent from the disclosure, which includes the specification with the foregoing and ongoing description, the claims, and the accompanying drawings wherein:

- FIG. 1 is a schematic longitudinal cross-section illustrating a plurality of flash bulb cartridges loaded in a light gun designed to fire these cartridges;
- FIG. 2 is a schematic transverse cross-section illustrating the design and construction of a high intensity flash bulb cartridge;
- FIG. 3 is a light curve illustrating the intensity of the cartridge as a function time;
- FIG. 4 is an enlarged longitudinal cross-section of the light gun shown in FIG. 1 further illustrating the design and construction of the automatic loading and ejection system using the flash bulb cartridges; and
- FIG. 5 is a schematic transverse cross-section of a cartridge shown in FIG. 4 to further illustrate its design and construction.

DESCRIPTION OF THE PREFERRED EMBODIMENT

As described above, the present invention provides a flash bulb cartridge for light guns capable of generating an ultra high intensity burst of light several orders of magnitude brighter than the noon-day sun for temporarily blinding an assailant at a distance. The cartridge is designed as a relatively small battery activated flash bulb having a nearly spherical shape containing magnesium filaments hermetically sealed with pure oxygen gas under pressure designed to boost the intensity of the flash. The cartridge is made of quartz glass to withstand the high temperature. The intensity is further boosted by coating the rear of the cartridge with a layer of reflective material so that the light flash is projected in the forward direction. The rear portion of the cartridge is shaped to concentrate the reflected light into a diverging beam.

Figure 1:
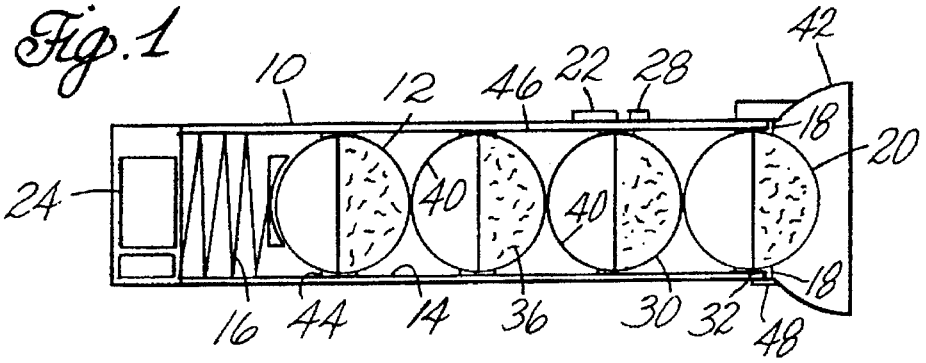
Figure 2:
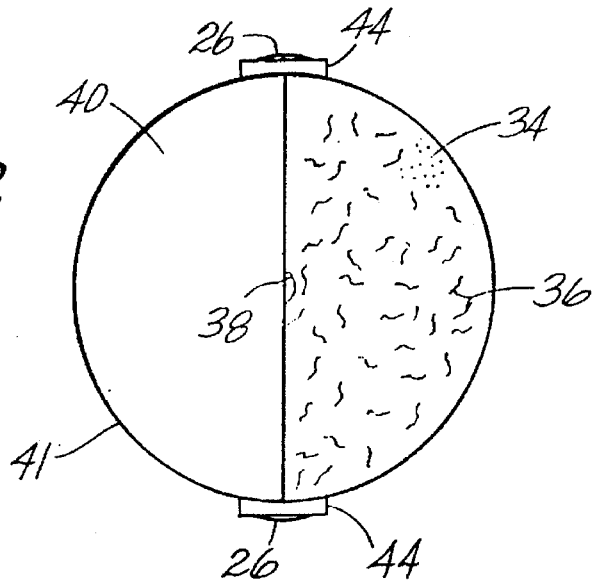

FIG. 1 is a schematic longitudinal cross-section of a light gun designed to fire the cartridges provided in the present invention. In order to better understand the design and operating principles of the cartridge, it is helpful to understand the basic operating principles of the light gun designed to fire these cartridges. As is illustrated in FIG. 1, the light gun 10 holds four flash bulbs cartridges 12 in a tube 14. A spring 16 exerts an outward force on the cartridges 12 that tends to push them out of the tube 14. Ejection pins 18, mounted on the front of the tube 14 holds the cartridges 12 inside the tube 14. The first cartridge 20 is fired by an electric switch 22 which passes an electric current from a battery 24 mounted behind the tube 14 into the cartridge 20 via electrodes 26 mounted on each side of the cartridges as shown in FIG. 2. After the cartridge 20 is fired, it is ejected from the tube 14 by pressing a button 28 which retracts the holding pins 18. This action ejects the spent cartridge 20 and the second cartridge 30 is automatically moved into the firing position by the spring 16. When the second bulb 30 moves into the firing position, the electrodes 26 make electrical contact with small plates 32 mounted at the end of the tube. When the firing switch 22 is triggered, current is fed into the plates 32 and hence into the cartridge 30.

Figure 3:
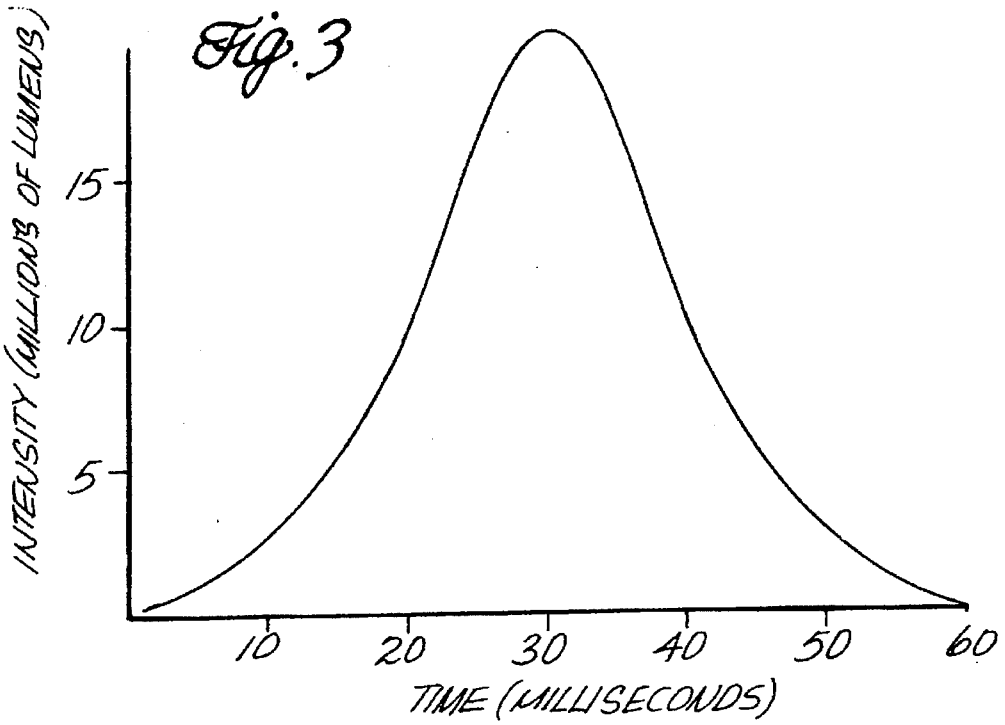

Referring to FIG. 2, the cartridges 12 have a nearly spherical shape with an outside diameter of 1.5 inches (3.21 cm) and are made with quartz glass. They are hermetically sealed with pure oxygen gas 34 at a pressure above ambient atmospheric pressure and contain many filaments of magnesium 36 designed to burn almost instantaneously in a brilliant flash of light. The magnesium filaments 36 are ignited by burning a small filament 38 with a current. By sealing the cartridges 12 with pure oxygen gas under pressure it is possible to place a relatively large amount of magnesium filaments into the cartridges 12 to generate a very intense light flash with a relatively small size. The resulting light flash will have a peak intensity of about 20 million ($2\times10^7$) lumens which is approximately 1,000 times brighter that the sun at noon on a clear day. The intensity will exceed 10 million ($10^7$) lumens for a period of about 20 milliseconds (20 m sec) which is sufficiently strong to cause temporary blinding for one or two minutes. The time to reach peak intensity is about 30 m sec. Since this time period is shorter than the blink of an eye, it is impossible to avoid receiving a blinding light flash by closing the eyes if the eyes were open when a cartridge is fired. FIG. 3 gives the intensity of the light flash as function of time.

The rear portion of the cartridge 12 has a paraboloidal shape and coated with a highly reflective layer 40 so that all of the light generated by the flash is directed and concentrated in front of the cartridge thereby increasing the intensity. Since the light flash will raise the temperature several thousand degrees inside the cartridge the resulting pressure could explode the glass. This may have a beneficial side effect in that the explosion could frighten and further disorient the blinded assailant. A metal protective cap 41 is mounted over the rear portion of the cartridge 12 to prevent any shattered glass from entering and damaging the light gun. An annular reflector 42 is mounted around the end of the robe 14 to concentrate the flash and further increase its intensity (see FIG. 1).

Figure 4:
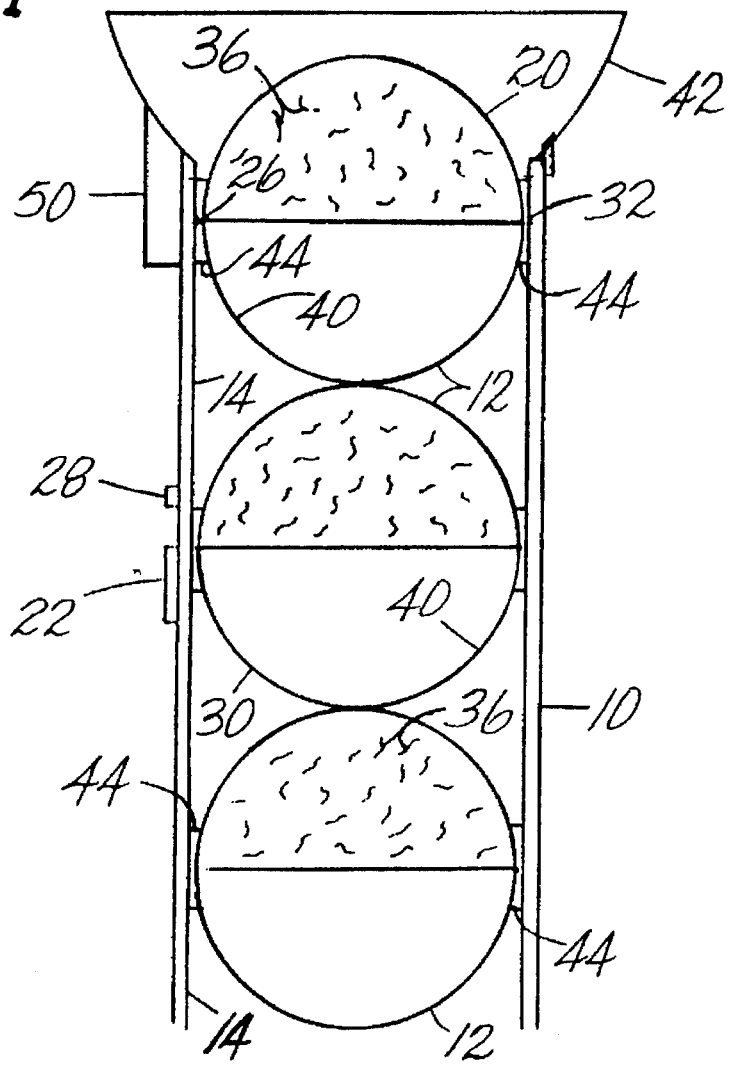
Figure 5:
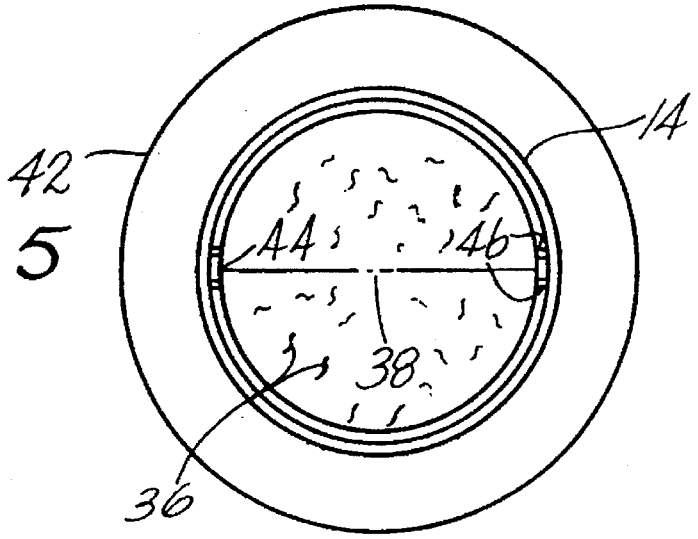

Two parallel rectangular guide flanges 44 are mounted on each side of the cartridge 12 which slide between two pairs of parallel guide tracks 46 extending longitudinally along the inside walls of the robe 14. These flanges 44 keep the cartridges 12 facing the forward direction while advancing through the robe 14 to the firing position. The electrodes 26 pass through the glass walls and through the guide flanges 44 and make contact with the rectangular plates 32 mounted between the tracks 46 at the end of the robe 14. FIGS. 4 and 5 are enlarged longitudinal and transverse cross-sections further illustrating the design and construction of the guide flanges 44 and the guide tracks 46.

Many modifications and variations of the above embodiments can be devised by one skilled in the art without departing from the scope of the invention. Thus, it is intended that all matter contained in the above description or shown in the accompanying drawings should be interpreted as illustrative and not in a limiting sense.

What is claimed is:

1. A flash bulb cartridge for light guns comprising:

a fast-burning combustible substance mounted inside a transparent bulb for generating a flash of light with an intensity of at least 10,000,000 lumens;

oxygen gas hermetically sealed inside said bulb for burning said combustible substance;

means for igniting said combustible substance with an electric current;

means for directing and concentrating said light flash along a given direction by coating a portion of the surface of said bulb with a reflecting layer; and guide means mounted on the side of said bulb in sliding engagement with rigid guide tracks for maintaining proper alignment.

2. A flash bulb cartridge as set forth in claim 1 wherein that portion of the bulb surface coated with said reflecting layer has a substantially paraboloidal shape.

3. A flash bulb cartridge as set forth in claim 1 wherein said oxygen gas sealed inside said bulb is pressurized to increase the intensity of said flash.

4. A flash bulb cartridge as set forth in claim 1 wherein said fast-burning substance is magnesium filaments.

5. A method for generating a light flash for blinding an assailant at a distance comprising the steps of:

mounting a fast-burning substance inside a partially transparent housing for generating a flash of light with an intensity of at least 10,000,000 lumens;

sealing oxygen gas inside said housing with said fast-burning substance;

coating a portion of said housing with a reflective layer to direct and concentrate said light flash along a certain direction;

maintaining said housing in a certain direction with guide means mounted on the side of said housing in sliding engagement with guide track means; and igniting said fast-burning substance to generate said flash with an electric current.

6. A method as set forth in claim 5 further comprising the step of shaping that portion of said housing coated with said reflective layer with a substantially paraboloidal form.

7. A method as set forth in claim 5 further comprising the step of pressurizing said oxygen sealed inside said housing to increase the intensity of said flash.

8. A method as set forth in claim 5 wherein said fast-burning substance is magnesium filaments and wherein said housing is quartz glass.

* * * * *

UNITED STATES PATENT AND TRADEMARK OFFICE

CERTIFICATE OF CORRECTION

PATENT NO. : 5,641,284
DATED : June 24, 1997
INVENTOR(S) : Michael Andrew Minovitch It is certified that error appears in the above-indentified patent and that said Letters Patent is hereby corrected as shown below:

Column 1, line 33, change "robe" to -- tube --.
Column 1, line 34, change "robes" to -- tubes --.
Column 3, lines 46,51,53,56, change "robe" to -- tube -- (all occurrences).

Signed and Sealed this

Fifth Day of May, 1998

*Attest:*

*Attesting Officer*

BRUCE LEHMAN

*Commissioner of Patents and Trademarks*